US010976691B2

(12) United States Patent
Masu

(10) Patent No.: US 10,976,691 B2
(45) Date of Patent: Apr. 13, 2021

(54) FIXING DEVICE AND IMAGE FORMING APPARATUS

(71) Applicant: Yuusuke Masu, Kanagawa (JP)

(72) Inventor: Yuusuke Masu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/858,931

(22) Filed: Apr. 27, 2020

(65) Prior Publication Data

US 2020/0356035 A1 Nov. 12, 2020

(30) Foreign Application Priority Data

May 7, 2019 (JP) ..... JP2019-087717

(51) Int. Cl.
*G03G 15/20* (2006.01)
*G03G 21/16* (2006.01)

(52) U.S. Cl.
CPC ..... *G03G 15/2064* (2013.01); *G03G 15/206* (2013.01); *G03G 15/2017* (2013.01); *G03G 15/2053* (2013.01); *G03G 21/1685* (2013.01); *G03G 2215/2003* (2013.01); *G03G 2215/2035* (2013.01)

(58) Field of Classification Search
CPC ..... G03G 15/2017; G03G 15/2053; G03G 15/206; G03G 15/2064; G03G 2215/2003; G03G 2215/2035; G03G 21/1685
See application file for complete search history.

(56) References Cited

U.S. PATENT DOCUMENTS

2003/0210923 A1* 11/2003 Pirwitz ..... G03G 15/2064 399/122
2005/0008411 A1* 1/2005 Chung ..... G03G 15/2064 399/328
2014/0153981 A1* 6/2014 Hasegawa ..... G03G 15/2053 399/329

FOREIGN PATENT DOCUMENTS

| | | |
|---|---|---|
| JP | 2004-036801 | 2/2004 |
| JP | 2004-039502 | 2/2004 |
| JP | 2006-139035 | 6/2006 |
| JP | 2007-017749 | 1/2007 |

* cited by examiner

*Primary Examiner* — Joseph S Wong
(74) *Attorney, Agent, or Firm* — Duft & Bornsen, PC

(57) ABSTRACT

A fixing device includes a pressure roller including a rotation shaft, a bearing that rotatably supports the rotation shaft, a first bracket mounted on a first end of the pressure roller in an axial direction thereof, and a second bracket mounted on a second end of the pressure roller in the axial direction thereof. Each of the first bracket and the second bracket includes a rotation shaft support face through which the rotation shaft of the pressure roller is inserted and a bearing support face disposed opposite an outer circumferential surface of the bearing. A first tab is mounted on the bearing support face of the first bracket. A second tab is mounted on the bearing support face of the second bracket. The first tab and the second tab are disposed upstream from the rotation shaft of the pressure roller in a recording medium conveyance direction.

14 Claims, 7 Drawing Sheets

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-087717, filed on May 7, 2019, in the Japan Patent Office, the entire disclosure of which is hereby incorporated by reference herein.

BACKGROUND

Technical Field

Exemplary aspects of the present disclosure relate to a fixing device and an image forming apparatus, and more particularly, to a fixing device and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses employ a fixing device that fixes a toner image on a recording medium such as a transfer sheet. For example, the fixing device includes a fixing rotator (e.g., a fixing roller and a fixing belt) and a pressure rotator (e.g., a pressure roller). The pressure rotator is pressed against the fixing rotator that is heated to form a nip therebetween. As the recording medium passes through the nip, the fixing rotator and the pressure rotator melt toner of the toner image borne on the recording medium, fixing the toner image on the recording medium.

The fixing device incorporates a plurality of components that is replaced periodically in addition to a case when the fixing device suffers from failure. Hence, work such as maintenance and replacement of the components is performed according to a usage condition.

The work is mainly performed by a service engineer. Processes of the work may adversely affect load imposed on the service engineer and labor costs of the service engineer, that increase costs imposed on a user. Hence, technology to improve and facilitate the work of the service engineer is proposed.

SUMMARY

This specification describes below an improved fixing device. In one embodiment, the fixing device includes a fixing rotator that rotates and a pressure roller that contacts the fixing rotator to form a nip between the fixing rotator and the pressure roller, through which a recording medium is conveyed in a recording medium conveyance direction. The pressure roller includes a rotation shaft. A bearing rotatably supports the rotation shaft of the pressure roller. A first bracket is mounted on a first end of the pressure roller in an axial direction thereof. A second bracket is mounted on a second end of the pressure roller in the axial direction thereof. Each of the first bracket and the second bracket includes a rotation shaft support face through which the rotation shaft of the pressure roller is inserted and a bearing support face disposed opposite an outer circumferential surface of the bearing. A first tab is mounted on the bearing support face of the first bracket. A second tab is mounted on the bearing support face of the second bracket. The first tab and the second tab are disposed upstream from the rotation shaft of the pressure roller in the recording medium conveyance direction.

This specification further describes an improved image forming apparatus. In one embodiment, the image forming apparatus includes an image bearer that bears an image and a fixing device that fixes the image on a recording medium. The fixing device includes a fixing rotator that rotates and a pressure roller that contacts the fixing rotator to form a nip between the fixing rotator and the pressure roller, through which the recording medium is conveyed in a recording medium conveyance direction. The pressure roller includes a rotation shaft. A bearing rotatably supports the rotation shaft of the pressure roller. A first bracket is mounted on a first end of the pressure roller in an axial direction thereof. A second bracket is mounted on a second end of the pressure roller in the axial direction thereof. Each of the first bracket and the second bracket includes a rotation shaft support face through which the rotation shaft of the pressure roller is inserted and a bearing support face disposed opposite an outer circumferential surface of the bearing. A first tab is mounted on the bearing support face of the first bracket. A second tab is mounted on the bearing support face of the second bracket. The first tab and the second tab are disposed upstream from the rotation shaft of the pressure roller in the recording medium conveyance direction.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
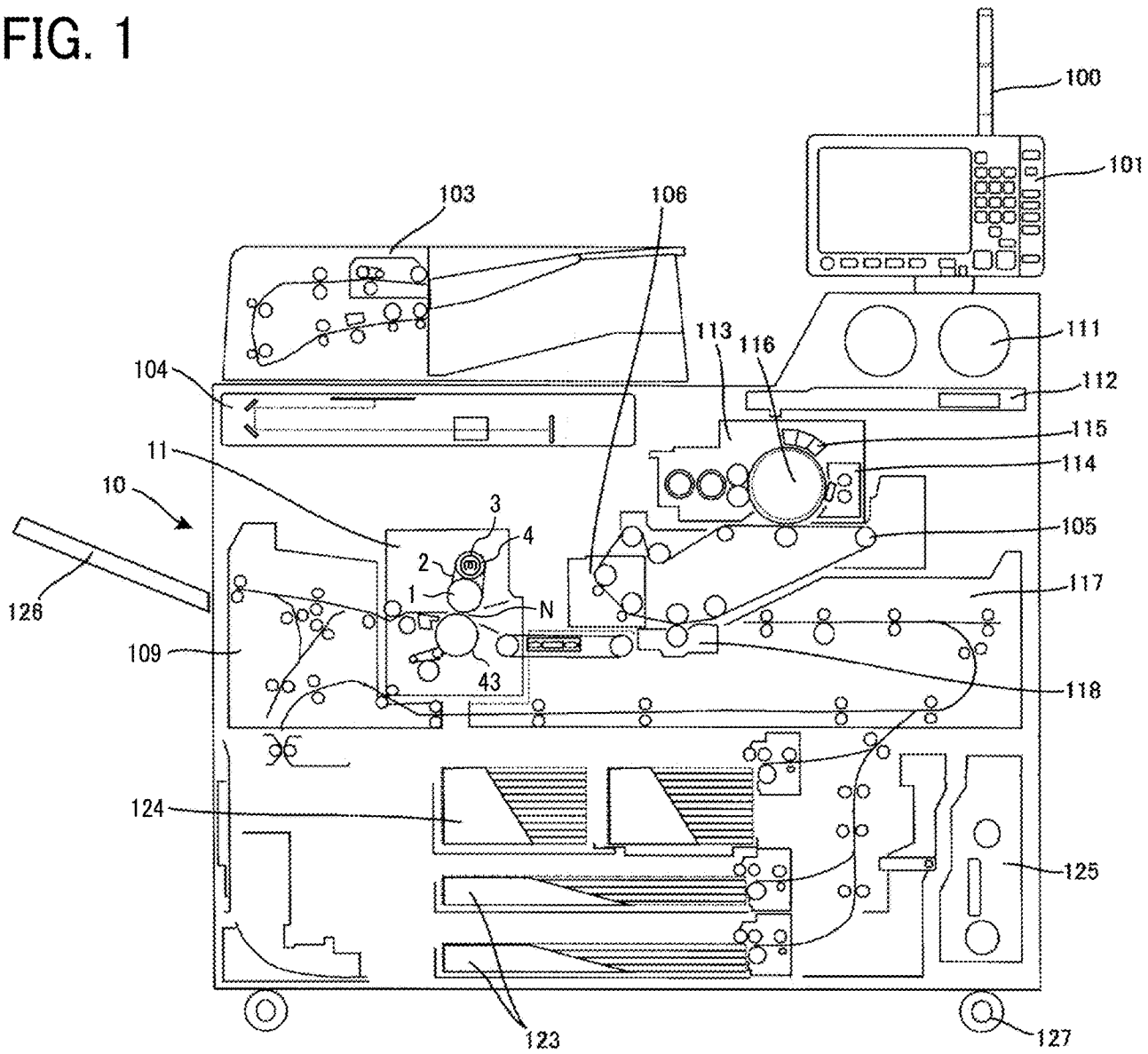
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a detailed description is provided of embodiments of the present disclosure. In the drawings, identical reference numerals are assigned to identical elements and equivalents and redundant descriptions of the identical elements and the equivalents are summarized or omitted properly.

Referring to drawings, a description is provided of a construction of a fixing device and an image forming apparatus according to the embodiments of the present disclosure.

Technology of the embodiments of the present disclosure is not limited to embodiments described below and may be modified within scopes suggested by those skilled in art, such as other embodiments, addition, modification, and deletion. The technology of the embodiments of the present disclosure encompasses various embodiments that achieve operations and advantages of the embodiments of the present disclosure.

Referring to FIG. 1, a description is provided of a construction of an image forming apparatus 10 according to an embodiment of the present disclosure.

FIG. 1 is a schematic cross-sectional view of the image forming apparatus 10. For example, the image forming apparatus 10 is a copier that forms a monochrome toner image. Additionally, the image forming apparatus 10 also serves as a printer when the image forming apparatus 10 is connected to a personal computer.

Since the image forming apparatus 10 according to this embodiment is the copier, the image forming apparatus 10 includes an original reader that serves as a scanner.

Alternatively, if the image forming apparatus 10 is a machine connected to a personal computer and exclusively used to output a print, such as a printer, and therefore incorporates a controller, the image forming apparatus 10 may omit the original reader.

The following describes a schematic construction and operations of the image forming apparatus 10 according to this embodiment.

The image forming apparatus 10 includes a scanner unit 104 that accommodates an illumination device, an optical system, a charge coupled device (CCD) image sensor, and the like.

Above the scanner unit 104 is an auto document feeder (ADF) unit 103 that feeds an original bearing an image. The ADF unit 103 conveys the original automatically to a reading face of an exposure glass.

An operator places the original on the exposure glass disposed in an upper portion of the scanner unit 104 or in the ADF unit 103. The operator selects a mode by using function selecting keys on a control panel 101. While checking information displayed on a liquid crystal screen, the operator sets desired image forming conditions by using numeric keys, function keys, and the like on the control panel 101. The image forming apparatus 10 incorporates a call indicator light 100 that notifies an operation status of the image forming apparatus 10 to the operator.

A sensor board unit (SBU) performs analog to digital (A/D) conversion on an image signal created by the scanner unit 104 that reads the image on the original. Thereafter, a laser writing unit 112 irradiates a photoconductive drum 116 with a laser beam. For example, a cylindrical lens of the laser writing unit 112 collects the laser beam. A polygon mirror causes the laser beam to scan the photoconductive drum 116 linearly in a main scanning direction, forming an electrostatic latent image on the photoconductive drum 116. A developing unit 113 includes a cleaning unit 114 and a charger 115 that surround the photoconductive drum 116. The charger 115 is used to charge a surface of the photoconductive drum 116.

A power supply unit (PSU) applies a high voltage to the charger 115 through a receptacle, an electrode terminal, a conductive bearing, and the like.

A conveying screw disposed inside the developing unit 113 stirs and mixes toner supplied from a toner supply unit 111 (e.g., a toner bottle) as needed and a developer that replenishes the developing unit 113 in advance and conveys the toner and the developer to a developing roller. The toner attracted electrostatically to the developing roller with a magnetic force is charged negatively.

A developer rising restrictor, such as a doctor blade and a casing, disposed below the developing roller restricts a two-component developer borne on the developing roller to an appropriate amount. Thereafter, a bias voltage moves toner of the two-component developer, that is charged frictionally, onto the photoconductive drum 116, adhering the toner to the electrostatic latent image selectively and forming a toner image. Thus, the photoconductive drum 116 serves as an image bearer that bears an image.

A toner density sensor disposed on a bottom face of the developing unit 113 detects the density of toner inside the developing unit 113 based on an amount of the charged toner.

After the toner image is transferred from the photoconductive drum 116, a cleaning blade disposed inside the cleaning unit 114 scrapes residual toner failed to be transferred and remained on the photoconductive drum 116 from the photoconductive drum 116 so that the residual toner is conveyed and collected into a waste toner bottle 125.

The developing unit 113 is surrounded properly by a Mylar® that prevents the toner from scattering and an entrance seal made of a sponge material.

The visible toner image formed on the photoconductive drum 116 with the toner is transferred onto and borne on an intermediate transfer belt unit 105 temporarily.

A transfer sheet is conveyed by a sheet conveyer 117 and passed through a registration portion. While the transfer sheet passes through a nip formed between the intermediate transfer belt unit 105 and a secondary transfer unit 118, a secondary transfer roller charges the toner of the toner image positively, transferring the toner image formed on the intermediate transfer belt unit 105 onto the transfer sheet.

After the toner image is transferred from the intermediate transfer belt unit 105, a cleaning blade disposed inside a belt cleaning unit 106 scrapes residual toner failed to be transferred and remained on the intermediate transfer belt unit 105 from the intermediate transfer belt unit 105 so that the residual toner is conveyed and collected into the waste toner bottle 125.

The PSU applies a high voltage to the secondary transfer roller through the receptacle, the electrode terminal, the conductive bearing, and the like.

In order to restrict fluctuation of a transfer electric current caused by a print environment, the type of a transfer sheet, and the like, the secondary transfer roller is performed with a constant electric current control. Additionally, the transfer electric current is switched properly according to selection of sheet feeding trays 123 and 124 (e.g., paper trays), the size of the transfer sheet, the thickness of the transfer sheet, and the like.

In order to prevent the toner adhered to the secondary transfer roller from staining a back side of the transfer sheet, the secondary transfer roller is applied with a negative bias at a predetermined time, thus returning the toner adhered to the secondary transfer roller to the intermediate transfer belt unit 105. Accordingly, the secondary transfer roller is cleaned.

The transfer sheet transferred with the toner image is conveyed to a fixing device 11 (e.g., a fuser unit). The fixing device 11 melts and fixes the toner image on the transfer sheet under constant temperature and pressure.

The fixing device 11 includes a fixing roller 1 disposed opposite a thermistor that detects the temperature of a surface of the fixing roller 1. Thus, the thermistor controls turning on and off of a heater 3. The thermistor may be a contact type thermistor that contacts the fixing roller 1 or a non-contact type thermistor that does not contact the fixing roller 1. The fixing device 11 further includes a thermal fuse that prevents overheating.

The fixing device 11 according to this embodiment includes the heater 3, a fixing belt 2 serving as a fixing member or a fixing rotator, and a pressure roller 43 that is rotatable and contacts the fixing belt 2. For example, the fixing device 11 includes the fixing belt 2 serving as a fixing member or a fixing rotator that is stretched taut across the fixing roller 1 and a heating roller 4. The pressure roller 43 presses against the fixing belt 2 to form a fixing nip N therebetween. A cam adjusts pressurization and depressurization of the pressure roller 43 at the fixing nip N. A heater may be disposed inside the pressure roller 43.

Other construction of the fixing device 11 is described below.

A fixing separation plate separates the transfer sheet bearing the toner image thermally fixed on the transfer sheet from the fixing belt 2 and the pressure roller 43. Thereafter, the transfer sheet passes through a reverse sheet ejection unit 109 or is performed with duplex printing according to a condition set by the operator. Thereafter, the transfer sheet is ejected onto a sheet ejection tray 126. Alternatively, if a finisher or the like is coupled to the image forming apparatus 10, the transfer sheet is conveyed to a transfer sheet entry of the finisher.

The image forming apparatus 10 further includes body moving casters 127.

The image forming apparatus 10 according to this embodiment forms the toner image on the transfer sheet by electrophotography with the construction and the operations described above.

A description is provided of a construction of a comparative image forming apparatus.

The comparative image forming apparatus includes a heating roll unit and a fixing device that have at least objectives below. A first objective is to facilitate replacement of a heating roll and a heater. A second objective is to decrease variation in position where the heater is attached with respect to the heating roll in an axial direction of the heating roll. A third objective is to facilitate installation and removal of the heater if a plurality of heaters is disposed inside the heating roll. In order to achieve the objectives, the heating roll unit includes a pair of bearings that is disposed at both lateral ends of the heating roll in the axial direction thereof, respectively. The heating roll unit further includes a pair of mounting members that is mounted on outer races of the pair of bearings, respectively. The pair of mounting members includes a first mounting member including a heater positioner that positions an outer end of the heater in a slide direction. The pair of mounting members further includes a second mounting member that supports a positioning resilient presser that presses the heater against the first mounting member. An operator catches a grip.

The heating roll unit improves work for replacing the heater by the operator. However, it is still requested to improve work such as maintenance of other unit that constructs the fixing device and replacement of parts of components that construct the unit.

For example, the operator may not handle a pressure roller of the fixing device easily due to the size and the weight of the pressure roller. When the operator grasps a grasping portion such as the grip to install and remove the pressure roller, if the operator drops the pressure roller accidentally, the pressure roller may be damaged and the operator may suffer from an injury and the like. Additionally, heat resistant grease is applied to a driving gear disposed at a lateral end of the pressure roller in an axial direction thereof. Hence, when the operator replaces the pressure roller, the grease may adhere to fingers, clothes, and the like of the operator. If a service engineer as the operator finds it difficult to replace the pressure roller at an office of a user, for example, the service engineer replaces a pressure unit that incorporates the pressure roller and other components that are not replaced at a service center, wasting time and increasing costs disadvantageously.

Referring to FIGS. 1 to 4, a description is provided of a construction of the fixing device 11 according to the embodiments of the present disclosure.

As illustrated in FIG. 1, the fixing device 11 according to the embodiments includes at least the heater 3, the fixing belt 2 serving as a fixing member or a fixing rotator that is rotatable, and the pressure roller 43 that contacts the fixing belt 2 to form the fixing nip N therebetween. Alternatively, the fixing device 11 may include a fixing roller that serves as a fixing member or a fixing rotator that contacts the pressure roller 43.

Figure 2:
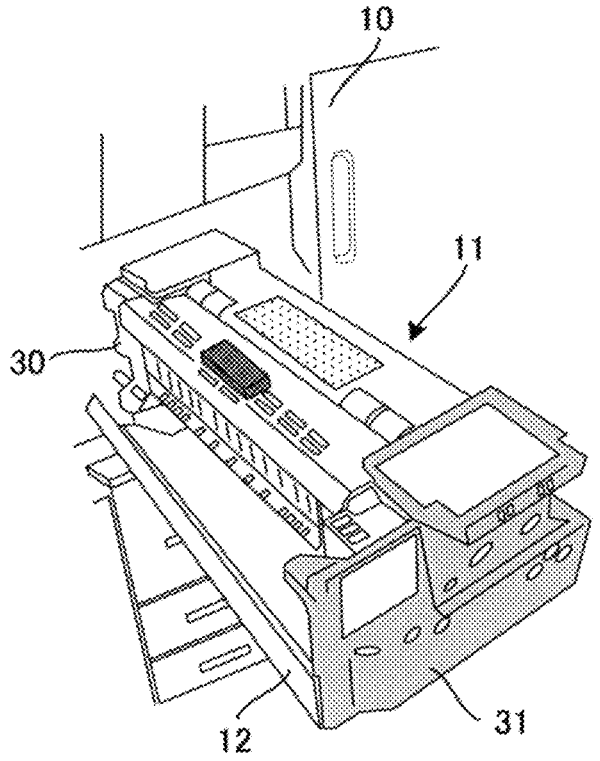
FIG. 2 is a schematic perspective view of a fixing device installed in the image forming apparatus depicted in FIG. 1.

As illustrated in FIG. 2, the fixing device 11 according to the embodiments is mounted on a slide rail 12 disposed inside the image forming apparatus 10 such that the fixing device 11 is pulled and drawn to an outside of the image forming apparatus 10.

The fixing device 11 includes a plurality of covers, that is, an inner cover 30 and an outer cover 31 which are disposed at a rear and a front of the fixing device 11, respectively, in a drawing direction in which the operator draws the fixing device 11 from the image forming apparatus 10.

Figure 3:
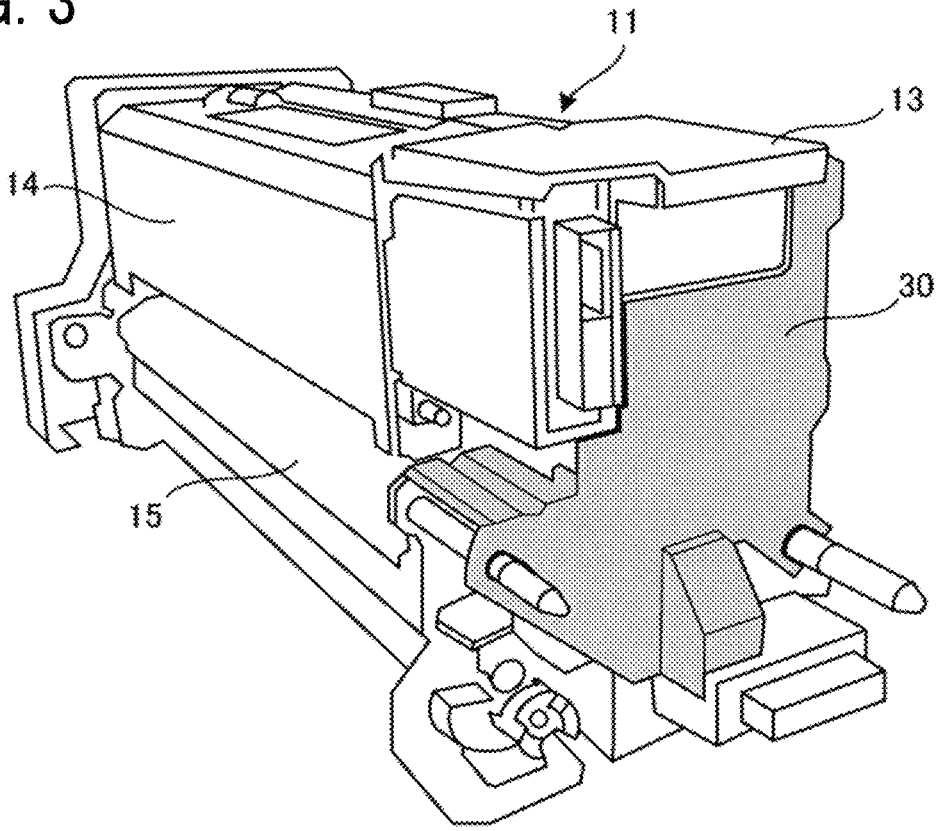
FIG. 3 is a perspective view of the fixing device depicted in FIG. 2, schematically illustrating an exterior of the fixing device.
Figure 4:
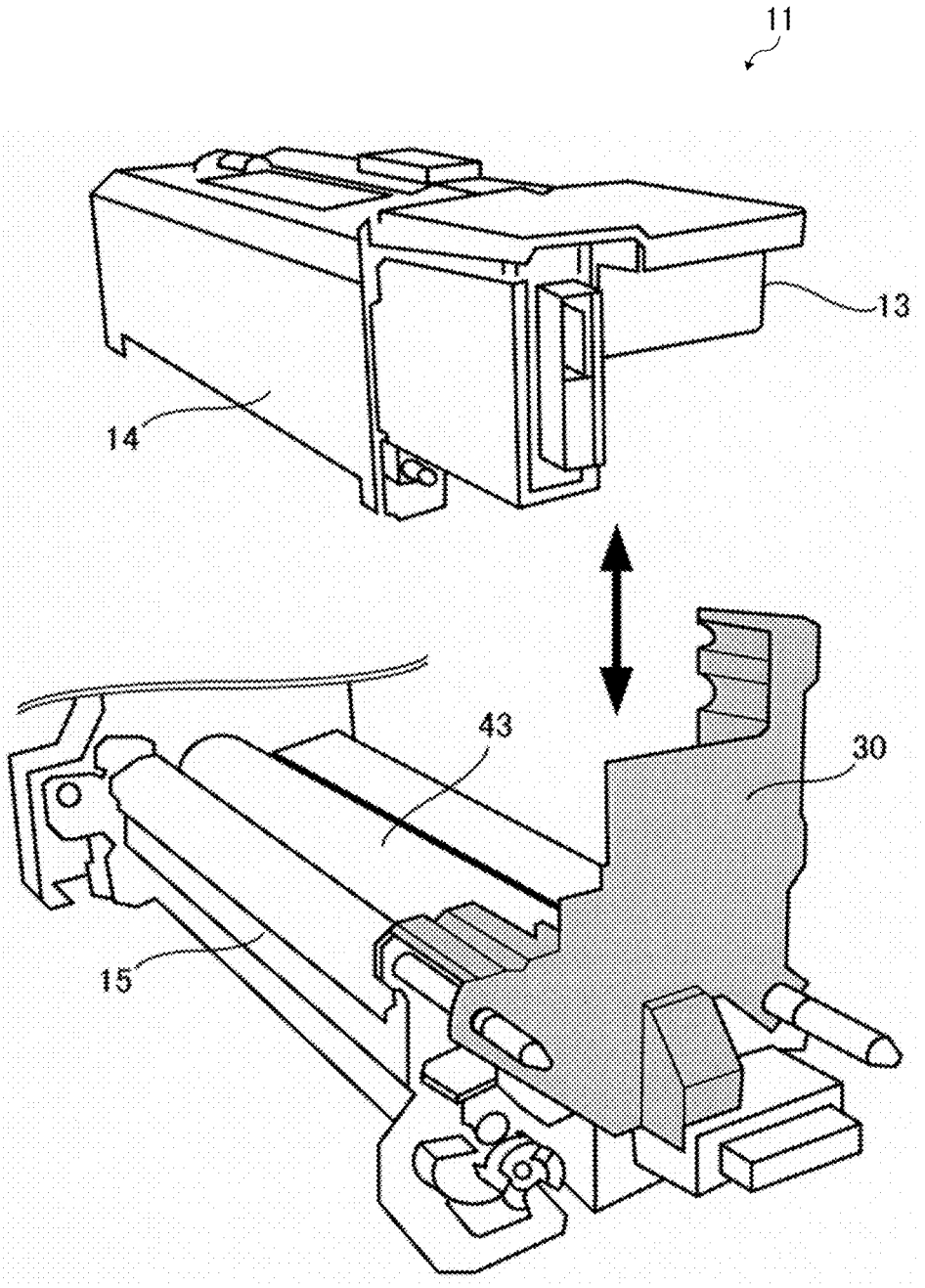
FIG. 4 is a perspective view of the fixing device depicted in FIG. 2, schematically illustrating the fixing device divided into an upper unit and a lower unit.

FIGS. 3 and 4 illustrate the fixing device 11 removed from the image forming apparatus 10.

As illustrated in FIG. 4, the fixing device 11 is divided into a separation unit 13 and a heating unit 14, that are disposed in an upper portion of the fixing device 11, and a pressure unit 15, that is disposed in a lower portion of the fixing device 11.

The pressure unit 15 includes the pressure roller 43 serving as a pressure rotator or a pressure member. The heating unit 14 includes the fixing belt 2 serving as a fixing rotator or a fixing member and the heater 3 depicted in FIG. 1. According to the embodiments, the fixing belt 2 serves as a fixing rotator or a fixing member. Alternatively, a roller or a combination of a roller and a belt may serve as a fixing rotator or a fixing member.

A description is provided of one example of processes for maintenance of the fixing device 11 such as replacement of parts and components of the fixing device 11.

First, after the image forming apparatus 10 depicted in FIG. 2 finishes printing, the operator draws the fixing device 11 placed on the slide rail 12 out of the image forming apparatus 10. The operator preferably draws the fixing device 11 out of the image forming apparatus 10 after the fixing device 11 is cooled sufficiently.

Next, the operator removes the fixing device 11 from the slide rail 12. The operator stationarily places the fixing device 11 on a work space and starts maintenance.

The operator releases fasteners that couple the separation unit 13, the heating unit 14, and the pressure unit 15, thus separating the separation unit 13 and the heating unit 14 from the pressure unit 15 vertically in FIG. 4.

After the fixing device 11 is divided into the separation unit 13, the heating unit 14, and the pressure unit 15, the operator performs necessary maintenance such as replacement of parts for a target one of the separation unit 13, the heating unit 14, and the pressure unit 15.

After the operator finishes maintenance, the operator combines the separation unit 13, the heating unit 14, and the pressure unit 15 into the fixing device 11, places the fixing device 11 on the slide rail 12, and presses the fixing device 11 into the image forming apparatus 10.

Figure 5A:
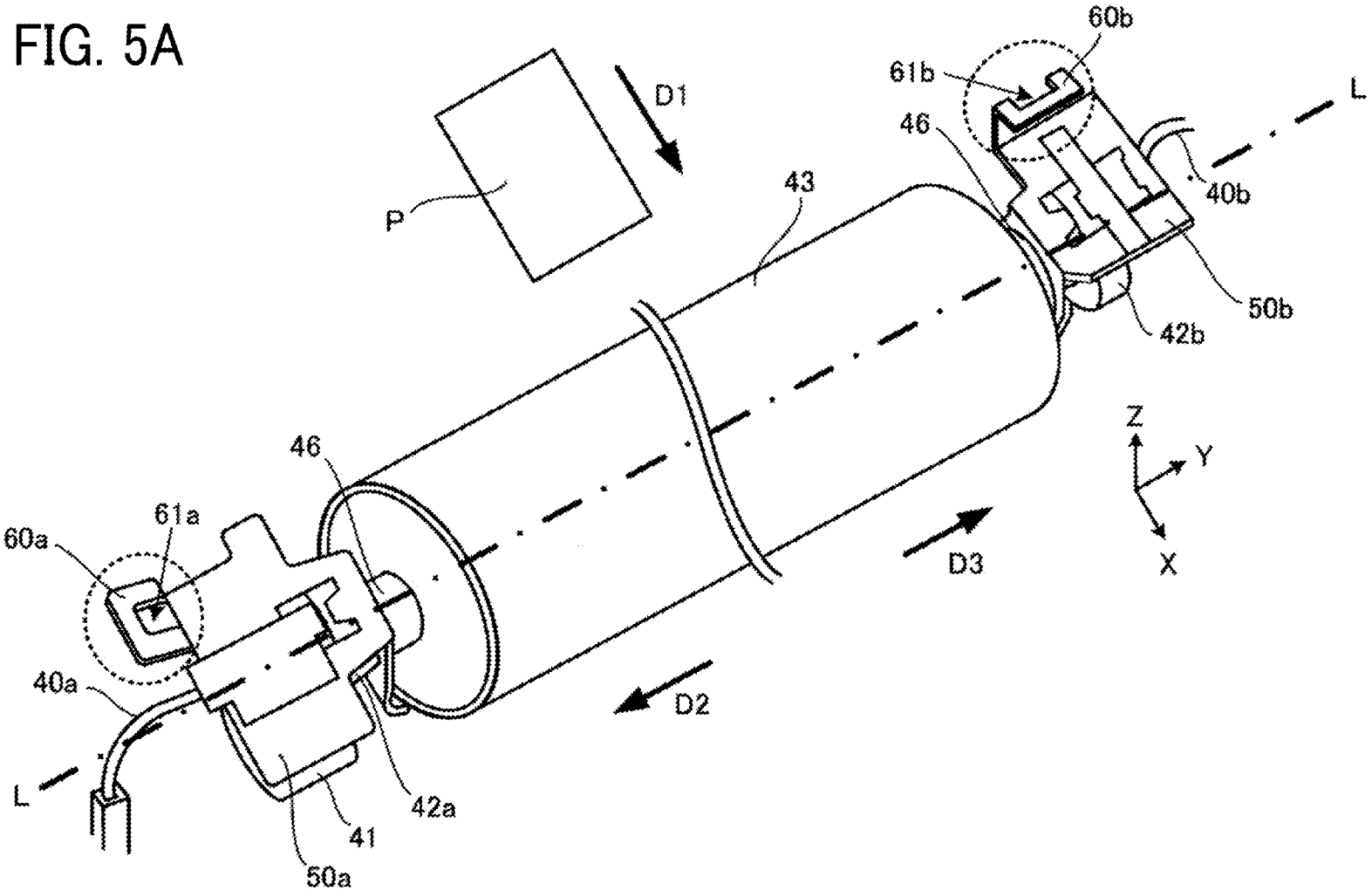
FIG. 5A is a perspective view of a pressure roller incorporated in the fixing device depicted in FIG. 4, schematically illustrating brackets mounted on both lateral ends of the pressure roller, respectively, in an axial direction of the pressure roller.

In the fixing device 11 according to the embodiments, brackets 50*a* and 50*b* are mounted on both lateral ends of the pressure roller 43, respectively, in an axial direction thereof indicated with a dotted line L in FIG. 5A.

Figure 5B:
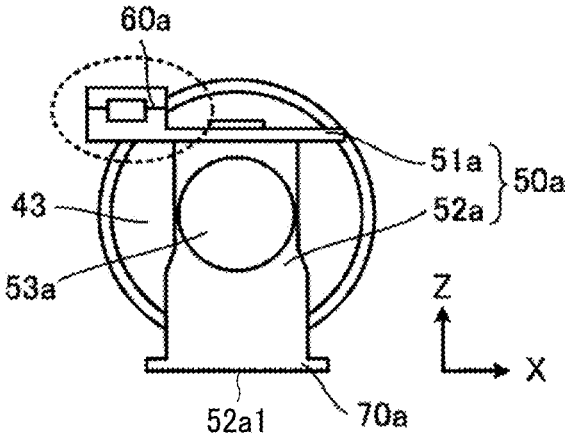
FIG. 5B is a side view of the pressure roller and the bracket mounted on one lateral end of the pressure roller in the axial direction thereof depicted in FIG. 5A.
Figure 5C:
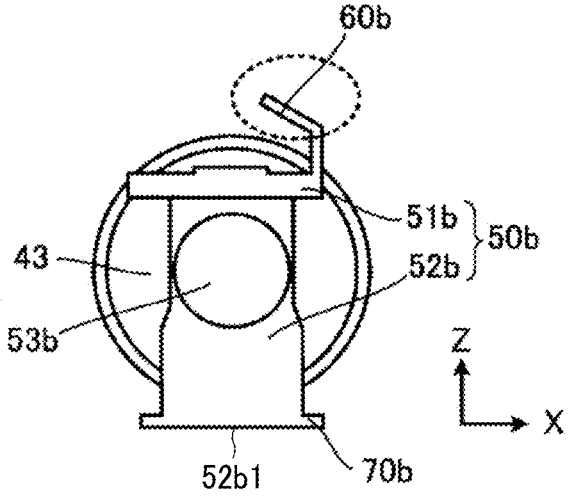
FIG. 5C is a side view of the pressure roller and the bracket mounted on another lateral end of the pressure roller in the axial direction thereof depicted in FIG. 5A.

FIG. 5A is a schematic perspective view of the pressure roller 43 and the brackets 50*a* and 50*b* mounted on both lateral ends of the pressure roller 43, respectively, in the axial direction thereof. FIG. 5B is a side view of the pressure roller 43 and the bracket 50*a*. FIG. 5C is a side view of the pressure roller 43 and the bracket 50*b*.

The bracket 50*a* includes a rotation shaft support face 52*a* and a bearing support face 51*a*. The bracket 50*b* includes a rotation shaft support face 52*b* and a bearing support face 51*b*. A rotation shaft 46 is inserted into rotation shaft supports 53*a* and 53*b* of the rotation shaft support faces 52*a* and 52*b*, respectively. The bearing support faces 51*a* and 51*b* are disposed opposite an outer circumferential surface of bearings 42*a* and 42*b* (e.g., ball bearings), respectively, that rotatably support the rotation shaft 46.

A driving gear 41 is coupled to one lateral end of the pressure roller 43 in the axial direction thereof. A heater is disposed inside the pressure roller 43. Heater harnesses 40*a* and 40*b* extend from both lateral ends of the pressure roller 43, respectively, in the axial direction thereof.

As illustrated in FIG. 5A, a recording medium P (e.g., a transfer sheet) is conveyed in a recording medium conveyance direction D1. A direction D2 is directed to a body of the image forming apparatus 10. For example, the direction D2 is directed to a rear of the image forming apparatus 10 in a state in which the fixing device 11 is installed in the image forming apparatus 10. The operator draws the fixing device 11 in a drawing direction D3 to remove the fixing device 11 from the body of the image forming apparatus 10. The direction D3 is directed to a front of the image forming apparatus 10 in a state in which the fixing device 11 is installed in the image forming apparatus 10.

In a description below, one lateral end of the pressure roller 43 in the axial direction thereof where the driving gear 41 is disposed, that is, a downstream portion of the pressure roller 43 in the direction D2, is referred to as a driving side. Another lateral end of the pressure roller 43 in the axial direction thereof, that is disposed in proximity to the front of the image forming apparatus 10, that is, a downstream portion of the pressure roller 43 in the drawing direction D3, is referred to as an operation side.

The fixing device 11 according to the embodiments includes tabs 60*a* and 60*b* mounted on the bearing support faces 51*a* and 51*b* of the brackets 50*a* and 50*b*, respectively. The operator holds the tabs 60*a* and 60*b* with his or her fingers.

Each of the tabs 60*a* and 60*b* is disposed upstream from the rotation shaft 46 of the pressure roller 43 in the recording medium conveyance direction D1 in which the recording medium P is conveyed.

Accordingly, when the operator holds the tabs 60*a* and 60*b* and lifts the pressure unit 15, the operator keeps a proper balance with a center of gravity of an entirety of the pressure unit 15 including the pressure roller 43.

A position of the tab 60*a* mounted on the bracket 50*a* disposed at one lateral end, that is, the driving side, of the pressure roller 43 in the axial direction thereof is preferably shifted in the recording medium conveyance direction D1 from a position of the tab 60*b* mounted on the bracket 50*b* disposed at another lateral end, that is, the operation side, of the pressure roller 43 in the axial direction thereof.

For example, as illustrated in FIG. 5A, the tab 60*a* mounted on the bracket 50*a* disposed at one lateral end, that is, the driving side, of the pressure roller 43 in the axial direction thereof projects from the bracket 50*a* in the axial direction of the pressure roller 43. The tab 60*b* mounted on the bracket 50*b* disposed at another lateral end, that is, the operation side, of the pressure roller 43 in the axial direction thereof projects from the bracket 50*b* in a direction perpendicular to the axial direction of the pressure roller 43.

The position of the tab 60*a* disposed at the driving side is shifted from the position of the tab 60*b* disposed at the operation side asymmetrically. Accordingly, the operator keeps a balance with respect to the center of gravity of the pressure unit 15 and the pressure roller 43 readily. Consequently, when the operator lifts and carries the pressure unit 15, the operator applies a force to the pressure unit 15 and handles the pressure unit 15 readily, improving work efficiency.

Further, as illustrated in FIG. 5A, the tabs 60*a* and 60*b* preferably include slots 61*a* and 61*b*, respectively.

When the operator holds the tabs 60*a* and 60*b*, the operator hooks his or her fingers into the slots 61*a* and 61*b*, respectively, preventing his or her fingers from slipping over the tabs 60*a* and 60*b* and thereby holding the tabs 60*a* and 60*b* precisely.

Next, a description is provided of embodiments of the tabs 60*a* and 60*b*.

The tabs 60*a* and 60*b* are angled relative to the bearing support faces 51*a* and 51*b*, respectively, at a predetermined angle.

Figure 6A:
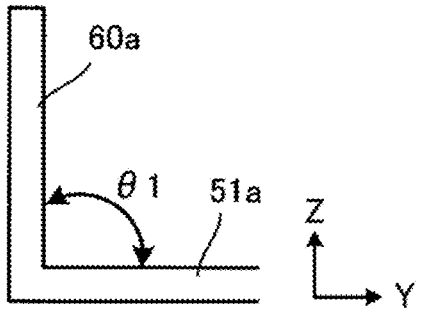
FIG. 6A is a cross-sectional view of a tab mounted on the bracket depicted in FIG. 5B and a bearing support face of the bracket, illustrating one example of an angle defined by the tab and the bearing support face.
Figure 6B:
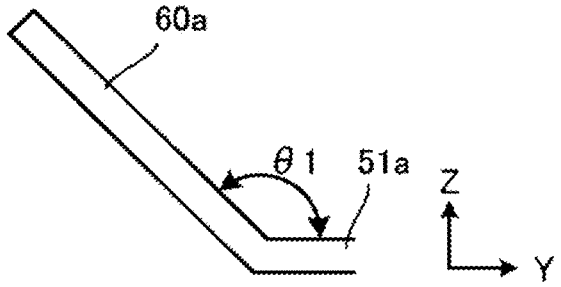
FIG. 6B is a cross-sectional view of the tab mounted on the bracket depicted in FIG. 5B and the bearing support face of the bracket, illustrating another example of the angle defined by the tab and the bearing support face.

FIGS. 6A, 6B, 6C, and 6D illustrate the embodiments of the tab 60*a*. As illustrated in FIGS. 6A and 6B, the tab 60*a* mounted on the bracket 50*a* disposed at one lateral end, that is, the driving side, of the pressure roller 43 in the axial direction thereof is preferably angled relative to the bearing support face 51*a* at an angle θ1 in a range of from 90 degrees to 135 degrees. FIGS. 7A, 7B, 7C, and 7D illustrate the embodiments of the tab 60*b*. As illustrated in FIGS. 7A and 7B, the tab 60*b* mounted on the bracket 50*b* disposed at another lateral end, that is, the operation side, of the pressure roller 43 in the axial direction thereof is preferably angled relative to the bearing support face 51*b* at an angle θ2 in a range of from 45 degrees to 90 degrees.

Figure 6C:
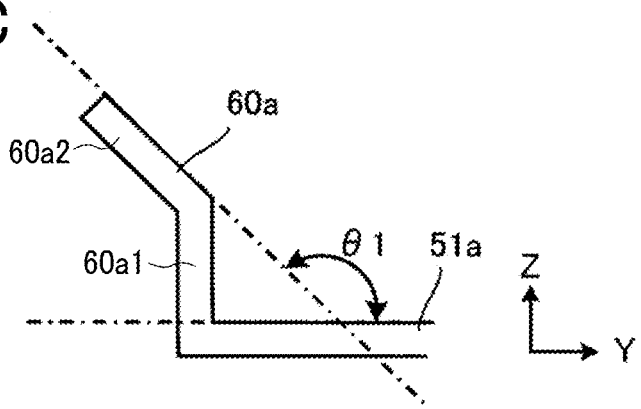
FIG. 6C is a cross-sectional view of an arm and a slope of the tab depicted in FIG. 6A.
Figure 7A:
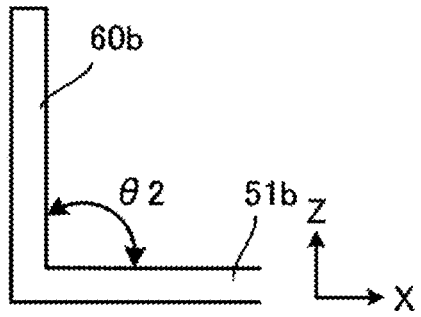
FIG. 7A is a cross-sectional view of a tab mounted on the bracket depicted in FIG. 5C and a bearing support face of the bracket, illustrating one example of an angle defined by the tab and the bearing support face.
Figure 7B:
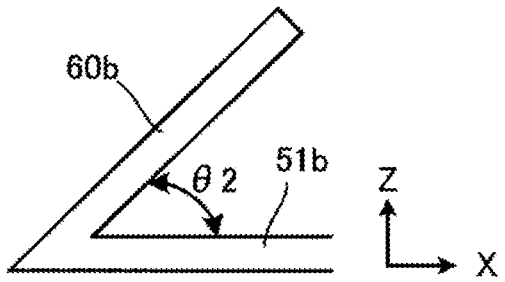
FIG. 7B is a cross-sectional view of the tab mounted on the bracket depicted in FIG. 5C and the bearing support face of the bracket, illustrating another example of the angle defined by the tab and the bearing support face.
Figure 7C:
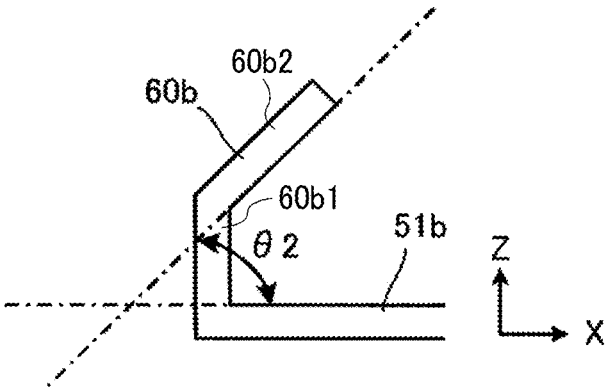
FIG. 7C is a cross-sectional view of an arm and a slope of the tab depicted in FIG. 7A.

As illustrated in FIGS. 6C and 7C, the tabs 60*a* and 60*b* mounted on the brackets 50*a* and 50*b* include arms 60*a*1 and 60*b*1 and slopes 60*a*2 and 60*b*2, respectively. The arms 60*a*1 and 60*b*1 are substantially perpendicular to the bearing support faces 51*a* and 51*b*, respectively. The slopes 60*a*2 and 60*b*2 bend from the arms 60*a*1 and 60*b*1, respectively. As illustrated in FIG. 6C, the slope 60*a*2 of the tab 60*a* mounted on the bracket 50*a* disposed at one lateral end, that is, the driving side, of the pressure roller 43 in the axial direction thereof is preferably angled relative to the bearing support face 51*a* at the angle θ1 in a range of from 90 degrees to 135 degrees. As illustrated in FIG. 7C, the slope 60*b*2 of the tab 60*b* mounted on the bracket 50*b* disposed at another lateral end, that is, the operation side, of the pressure roller 43 in the axial direction thereof is preferably angled relative to the bearing support face 51*b* at the angle θ2 in a range of from 45 degrees to 90 degrees.

Figure 6D:
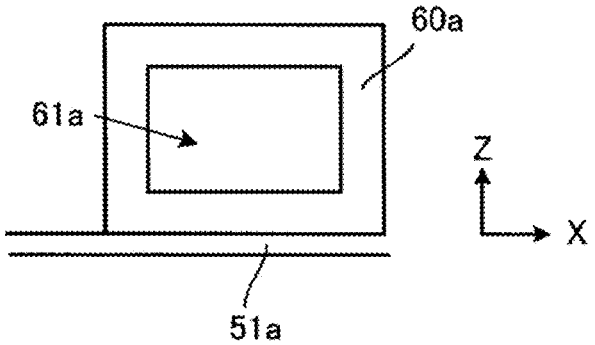
FIG. 6D is a cross-sectional view of the tab depicted in FIG. 6A and a slot of the tab.
Figure 7D:
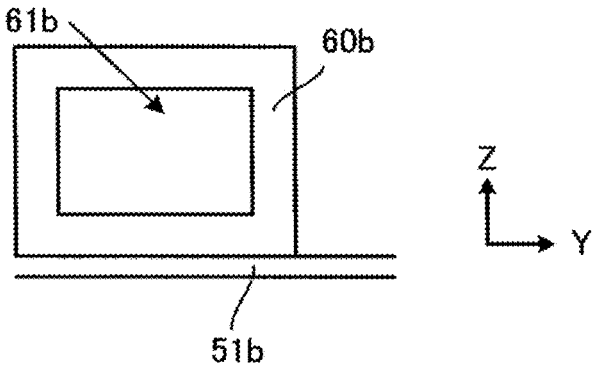
FIG. 7D is a cross-sectional view of the tab depicted in FIG. 7A and a slot of the tab.

As illustrated in FIGS. 6D and 7D, the tabs 60*a* and 60*b* include the slots 61*a* and 61*b*, respectively. When the operator holds the tabs 60*a* and 60*b*, the operator hooks his or her fingers into the slots 61*a* and 61*b*, respectively.

Accordingly, the operator holds the tabs 60*a* and 60*b* readily and precisely, improving operation and handling of the pressure roller 43.

For example, as illustrated in FIGS. 6C and 7C, the slopes 60*a*2 and 60*b*2 bend from the arms 60*a*1 and 60*b*1, respectively. The arms 60*a*1 and 60*b*1 preferably include the slots 61*a* and 61*b*, respectively. Each of the slots 61*a* and 61*b* has a length and a width that facilitate the operator to insert and hook his or her fingers into the slots 61*a* and 61*b*.

As described above, the operator holds the tabs 60*a* and 60*b* and lifts at least one of the pressure roller 43 and the pressure unit 15. The operator carries and places at least one of the pressure roller 43 and the pressure unit 15 onto the work space or the like temporarily. In a state in which at least one of the pressure roller 43 and the pressure unit 15 is placed on the work space, a surface of the pressure roller 43 is requested to separate from a placement surface on or over which at least one of the pressure roller 43 and the pressure unit 15 is placed and not to fall down.

As illustrated in FIGS. 5B and 5C, in the fixing device 11 according to this embodiment, the rotation shaft support faces 52*a* and 52*b* of the brackets 50*a* and 50*b*, that abut on the bearing support faces 51*a* and 51*b*, respectively, include opposed ends 52*a*1 and 52*b*1 that are opposite the bearing support faces 51*a* and 51*b* vertically in a direction Z, that is, in the direction perpendicular to the axial direction of the pressure roller 43. The opposed ends 52*a*1 and 52*b*1 mount legs 70*a* and 70*b*, respectively. A length of the rotation shaft support face 52*a*, which is defined from the bearing support face 51*a* (e.g., a bearing support face side of the rotation shaft support face 52*a*) to the opposed end 52*a*1 in the direction Z, is greater than a diameter of the pressure roller 43. A length of the rotation shaft support face 52*b*, which is defined from the bearing support face 51*b* (e.g., a bearing support face side of the rotation shaft support face 52*b*) to the opposed end 52*b*1 in the direction Z, is greater than the diameter of the pressure roller 43. When the pressure roller 43 is removed from the pressure unit 15, the legs 70*a* and 70*b* contact the placement surface.

The legs 70*a* and 70*b* contact the placement surface. For example, as illustrated in FIGS. 5B and 5C, the legs 70*a* and 70*b* project horizontally beyond the rotation shaft support faces 52*a* and 52*b*, respectively, in a direction X, that is, the direction perpendicular to the axial direction of the pressure roller 43. The shape of each of the legs 70*a* and 70*b* is not limited to that illustrated in FIGS. 5B and 5C. Each of the legs 70*a* and 70*b* may have a shape that attains stability of the legs 70*a* and 70*b* placed on the placement surface. For example, each of the legs 70*a* and 70*b* may have a shape created by properly adjusting lengths in directions X and Y and a contact area with which each of the legs 70*a* and 70*b* contacts the placement surface.

The rotation shaft support faces 52*a* and 52*b* configured as described above decrease risks of damaging the pressure roller 43 when the pressure roller 43 is removed from the image forming apparatus 10.

The operator places the removed pressure roller 43 on the work space and performs necessary work such as maintenance and replacement of parts (e.g., replacement of components of the heater 3).

As described above, the fixing device 11 according to the embodiments improves operations of the operator to install and remove the pressure roller 43 and the pressure unit 15 and to carry the pressure roller 43 and the pressure unit 15 when the pressure roller 43 and the pressure unit 15 are removed. The fixing device 11 further improves stability in placing the pressure roller 43 and the pressure unit 15 temporarily. Accordingly, regardless of a work environment and a work condition, the fixing device 11 improves work of the operator, such as maintenance and replacement of parts of the pressure unit 15 that includes the pressure roller 43.

A description is provided of advantages of a fixing device (e.g., the fixing device 11).

As illustrated in FIGS. 1, 5A, 5B, and 5C, the fixing device includes a heater (e.g., the heater 3), a fixing rotator (e.g., the fixing belt 2), a pressure roller (e.g., the pressure roller 43), a first bracket (e.g., the bracket 50*a*), a second bracket (e.g., the bracket 50*b*), a bearing (e.g., the bearings 42*a* and 42*b*), a first tab (e.g., the tab 60*a*), and a second tab (e.g., the tab 60*b*).

The fixing rotator is rotatable. The pressure roller contacts the fixing rotator to form a nip (e.g., the fixing nip N) between the fixing rotator and the pressure roller, through which a recording medium (e.g., the recording medium P) is conveyed in a recording medium conveyance direction (e.g., the recording medium conveyance direction D1). The pressure roller includes a rotation shaft (e.g., the rotation shaft 46). The first bracket and the second bracket are mounted on a first end and a second end of the pressure roller, respectively, in an axial direction thereof. Each of the first bracket and the second bracket includes a rotation shaft support face (e.g., the rotation shaft support faces 52*a* and 52*b*).

The rotation shaft of the pressure roller is inserted into the rotation shaft support face. The bearing rotatably supports the rotation shaft of the pressure roller. Each of the first bracket and the second bracket further includes a bearing support face (e.g., the bearing support faces 51*a* and 51*b*). The bearing support face is disposed opposite an outer circumferential surface of the bearing. The bearing support face of the first bracket mounts the first tab and the bearing support face of the second bracket mounts the second tab. The first tab and the second tab are held by fingers of an operator. The first tab and the second tab are disposed upstream from the rotation shaft of the pressure roller in the recording medium conveyance direction.

Accordingly, the fixing device improves work of the operator, such as maintenance and replacement of parts of a pressure unit incorporating the pressure roller regardless of a work environment and a work condition.

According to the embodiments described above, the fixing belt 2 serves as a fixing rotator. Alternatively, a fixing roller, a fixing film, a fixing sleeve, or the like may be used as a fixing rotator. Further, the pressure roller 43 serves as a pressure rotator. Alternatively, a pressure belt or the like may be used as a pressure rotator.

According to the embodiments described above, the image forming apparatus 10 is a copier. Alternatively, the image forming apparatus 10 may be a printer, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

a fixing rotator configured to rotate;

a pressure roller configured to contact the fixing rotator to form a nip between the fixing rotator and the pressure roller, the nip through which a recording medium is conveyed in a recording medium conveyance direction, the pressure roller including a rotation shaft;

a bearing configured to rotatably support the rotation shaft of the pressure roller;

a first bracket mounted on a first end of the pressure roller in an axial direction of the pressure roller;

a second bracket mounted on a second end of the pressure roller in the axial direction of the pressure roller, each of the first bracket and the second bracket including:

a rotation shaft support face through which the rotation shaft of the pressure roller is inserted; and a bearing support face disposed opposite an outer circumferential surface of the bearing;

a first tab mounted on the bearing support face of the first bracket; and a second tab mounted on the bearing support face of the second bracket, the first tab and the second tab being disposed upstream from the rotation shaft of the pressure roller in the recording medium conveyance direction.

2. The fixing device according to claim 1, wherein the first tab is at a position shifted from the second tab in the recording medium conveyance direction.

3. The fixing device according to claim 1, wherein the first tab is configured to project from the first bracket in the axial direction of the pressure roller, and wherein the second tab is configured to project from the second bracket in a direction perpendicular to the axial direction of the pressure roller.

4. The fixing device according to claim 1, wherein the first tab is angled relative to the bearing support face of the first bracket at an angle in a range of from 90 degrees to 135 degrees, and wherein the second tab is angled relative to the bearing support face of the second bracket at an angle in a range of from 45 degrees to 90 degrees.

5. The fixing device according to claim 4, wherein each of the first tab and the second tab includes:

an arm substantially perpendicular to the bearing support face; and a slope bending from the arm.

6. The fixing device according to claim 5, wherein the slope of the first tab is angled relative to the bearing support face of the first bracket at the angle in the range of from 90 degrees to 135 degrees, and wherein the slope of the second tab is angled relative to the bearing support face of the second bracket at the angle in the range of from 45 degrees to 90 degrees.

7. The fixing device according to claim 1, wherein each of the first tab and the second tab includes a slot.

8. The fixing device according to claim 7, wherein the slot is configured to be hooked with a finger of an operator.

9. The fixing device according to claim 1, wherein the rotation shaft support face abuts on the bearing support face, wherein the rotation shaft support face includes an opposed end opposite the bearing support face in a direction perpendicular to the axial direction of the pressure roller, and wherein a length of the rotation shaft support face, which is defined from the bearing support face to the opposed end, is greater than a diameter of the pressure roller.

10. The fixing device according to claim 9, further comprising a leg disposed at the opposed end and configured to contact a placement surface over which the pressure roller is placed when the pressure roller is removed from the fixing device.

11. The fixing device according to claim 10, wherein the leg is configured to project horizontally beyond the rotation shaft support face.

12. The fixing device according to claim 1, further comprising a heater configured to heat the fixing rotator.

13. The fixing device according to claim 1, wherein the first tab and the second tab are configured to be held by fingers of an operator, respectively.

14. An image forming apparatus comprising:

an image bearer configured to bear an image; and a fixing device configured to fix the image on a recording medium, the fixing device including:

a fixing rotator configured to rotate;

a pressure roller configured to contact the fixing rotator to form a nip between the fixing rotator and the pressure roller, the nip through which the recording medium is conveyed in a recording medium conveyance direction, the pressure roller including a rotation shaft;

a bearing configured to rotatably support the rotation shaft of the pressure roller;

a first bracket mounted on a first end of the pressure roller in an axial direction of the pressure roller;

a second bracket mounted on a second end of the pressure roller in the axial direction of the pressure roller, each of the first bracket and the second bracket including:

a rotation shaft support face through which the rotation shaft of the pressure roller is inserted; and a bearing support face disposed opposite an outer circumferential surface of the bearing;

a first tab mounted on the bearing support face of the first bracket; and a second tab mounted on the bearing support face of the second bracket, the first tab and the second tab being disposed upstream from the rotation shaft of the pressure roller in the recording medium conveyance direction.

* * * * *